US009032967B2

(12) United States Patent
Bordone

(10) Patent No.: US 9,032,967 B2
(45) Date of Patent: May 19, 2015

(54) ANTI-SMOKING DEVICE

(71) Applicant: Guiseppe Bordone, Valley Stream, NY (US)

(72) Inventor: Guiseppe Bordone, Valley Stream, NY (US)

( * ) Notice: Subject to any disclaimer, the term of this patent is extended or adjusted under 35 U.S.C. 154(b) by 0 days.

(21) Appl. No.: 13/849,960

(22) Filed: Mar. 25, 2013

(65) Prior Publication Data

US 2014/0116454 A1 May 1, 2014

Related U.S. Application Data

(60) Provisional application No. 61/614,781, filed on Mar. 23, 2012.

(51) Int. Cl.
*A24F 47/00* (2006.01)
*A44C 9/00* (2006.01)

(52) U.S. Cl.
CPC ..... *A24F 47/00* (2013.01); *A44C 9/0076* (2013.01)

(58) Field of Classification Search
USPC ..... 602/22; D11/26; 63/15; 131/329, 270
See application file for complete search history.

(56) References Cited

U.S. PATENT DOCUMENTS

| | | | | | |
|---|---|---|---|---|---|
| 3,421,761 | A | * | 1/1969 | Grant | 473/61 |
| 3,563,545 | A | * | 2/1971 | Rasche | 473/61 |
| 4,207,880 | A | | 6/1980 | Zinkovich | |
| 4,455,019 | A | | 6/1984 | Harris | |
| 4,552,359 | A | * | 11/1985 | McDonald | 473/61 |
| 4,615,046 | A | * | 10/1986 | Martin | 2/21 |
| 4,942,644 | A | * | 7/1990 | Rowley | 24/16 PB |
| 5,058,576 | A | | 10/1991 | Grim et al. | |
| D347,156 | S | * | 5/1994 | Starrett et al. | D29/120.2 |
| 5,560,375 | A | | 10/1996 | Kabanek | |
| 6,364,257 | B1 | * | 4/2002 | Holder | 248/74.3 |
| 6,458,149 | B1 | | 10/2002 | Peters-Combs | |
| 6,839,305 | B2 | | 1/2005 | Perlman et al. | |
| 7,169,121 | B2 | | 1/2007 | Berrehail | |
| 7,334,275 | B1 | * | 2/2008 | Kirkwood | 5/81.1 R |
| D595,897 | S | | 7/2009 | Moldauer et al. | |
| D600,818 | S | | 9/2009 | Yang | |
| 2009/0025743 | A1 | | 1/2009 | Dragos | |

FOREIGN PATENT DOCUMENTS

| | | | |
|---|---|---|---|
| JP | 2005-103207 | * | 4/2005 |
| JP | 2006190013 | A | 7/2006 |
| WO | WO8605680 | A1 | 10/1986 |
| WO | WO 2007/007970 | * | 1/2007 |

* cited by examiner

*Primary Examiner* — Richard Crispino
*Assistant Examiner* — Dionne W Mayes
(74) *Attorney, Agent, or Firm* — Gearhart Law, LLC

(57) ABSTRACT

The current invention discloses an inexpensive, easy to use anti-smoking device. The device has an elongated strip having a center portion, a first arm, and second arm along the elongated strip, and a center piece that is attached to the center portion of the elongated strip. The first arm and second arm of the elongated strip can be wrapped around the center piece to attach to the center piece, forming two loops that allow two fingers of the person trying to quit smoking to engage the anti-smoking device. The center piece is to be stuck between two fingers, preferably the fingers the person trying to quit smoking normally uses to clutch cigarettes. The center piece is sized so that two fingers cannot be held close enough to clutch a cigarette.

17 Claims, 5 Drawing Sheets

ANTI-SMOKING DEVICE

This application is a US utility patent application claiming priority from U.S. provisional application 61/614,781 filed on Mar. 23, 2012, the contents of which are fully incorporated by reference.

FIELD OF THE INVENTION

The invention relates to a non-intrusive, easy-to-use anti-smoking device, and more particularly to an anti-smoking device that prevents the physical access to cigarettes and reminds the person using the device and the people around him/her that a conspicuous effort is under way to quit smoking.

BACKGROUND OF THE INVENTION

Smoking is one of the most harmful behaviors to human health. It is identified as a major contributing factor to a series of diseases, which entail significant health risk. Such diseases include but are not limited to various kinds of cancer, cardiovascular conditions, bronchitis, pneumonia; asthma, and emphysema. Estimations from the Center for Disease and Control (CDC) put cigarette-smoking related deaths in the US at about 440,000 per year. In addition to the harm to human health, smoking also causes enormous economic loss. According to the CDC's estimate, cigarette smoking was responsible for $193 billion in annual health-related economic losses during 2000-2004 in the United States.

The current invention employs a novel approach to facilitate a person's effort to quit smoking. The anti-smoking device introduced by the current invention focuses on restricting a person's physical access to cigarettes and providing constant reminder and stress relief to the person. The device is a small, inexpensive accessory that can be worn by a person who is trying to quit smoking on his/her hand. By wearing the device, the user will have significant difficulty in clutching a cigarette. In addition, the user may squeeze the device for stress relief and craving control. Moreover, since many instances of failure to quit started with a casual smoke, sometimes under the urging of a friend or acquaintance, the anti-smoking device of the current invention also serves to remind the person who is trying to quit as well as his/her friends that a conspicuous effort to quit smoking is under way while disturbance of that effort is unwelcome. In summary, the anti-smoking device disclosed by the current invention is an apparatus that restricts a wearer's physical access to cigarettes as wells as a behavioral mechanism tool that helps the wearer to change his/her habits.

Previous anti-smoking approaches focus mostly on aiding the person trying to quit through chemical intervention, such as pharmaceutical products, or psychological encouragements, such as advertising campaigns. The current invention employs a novel approach to facilitate a person's efforts to quite smoking. The device and method disclosed herein prevents the person from clutching a cigarette in a casual manner. Moreover, by wearing the device, the person trying to quit demonstrates the resolve to quit smoking, reducing the chance he/she is to be subjected to peer pressure to starting to smoke.

In terms of structure of the device, some pervious patents or publications have disclosed devices that can be worn on a person's hand. However, not only do the prior arts serve completely different functions, they also have distinctive structures from the current invention.

DESCRIPTION OF THE RELATED ART

U.S. Pat. No. 6,458,149 discloses a device and method for treating stress-induced habits including smoking, drinking, overeating and the like. The invention consists of an adult pacifier made of a flavored or unflavored resilient material, orthodontically shaped to fit inside the mouth and on the tongue of the user. In moments of stress or when the urge to smoke, overeat, or drink arises, the device is placed on the tongue in the mouth and sucked. The simultaneous suction and tongue undulation, much like the stimulation caused by smoking cigarettes, and the like, encourages deep breathing and causes salivation, gastric acid secretion and stimulation of the cranial nerve endings in the tongue.

U.S. Pat. No. 5,058,576 discloses an adjustable wrist and hand splint, which employs four rigid aluminum stays for providing support for the forearm, fourth and fifth fingers and the outer portion of the hand. The aluminum stays are bendable for accommodating particular needs of the user. The splint also employs a sleeve that encompasses and provides further support for the forearm, fourth and fifth fingers and outer portion of the hand. The sleeve also provides padding between the stays and the forearm, hand and fingers. In addition, the splint includes pockets that are secured to the sleeve. The aluminum stays are housed within the pockets. Further, the splint may be readily put on or removed using a set of adjustable straps. The straps normally include "Velcro" type material that engage the mating "Velcro" type material on the surface of the sleeve. The fastening straps also help to further immobilize the wrist, fourth and fifth fingers and outer portion of the hand.

U.S. Pat. No. 7,169,121 discloses a medical device for syndactyly of at least two finger or toes, said device being in one piece and the comprising at least two rings joined via at least one connection bar in such a way as to permit sliding of the syndactylized fingers or toes relative to one another.

Various implements are known in the art, but their structures are distinctively different from the current invention. Moreover, the prior arts fail to address all of the problems solved by the invention described herein. One embodiment of this invention is illustrated in the accompanying drawings and will be described in more detail herein below.

SUMMARY OF THE INVENTION

The invention discloses an anti-smoking device. The device has an elongated strip having a center portion, a first arm, and a second arm along the elongated strip, and a center piece that is attached to the center portion of the elongated strip. The first arm and second arm of the elongated strip can be wrapped around the center piece to attach to the center piece, forming two loops that allow two fingers of the person trying to quit smoking to engage the anti-smoking device. The center piece is to be stuck between two fingers, preferably the fingers the person trying to quite smoking normally uses to clutch a cigarette. The center piece is sized so that two fingers cannot be held close enough to clutch a cigarette.

In addition to the physical restrictions, the anti-smoking device serves as a behavioral mechanism tool to help the wearer to change his/her habits and provides a reminder to the user of the device and his/her friends or acquaintances that he/she is trying to quit smoking. The user may squeeze the center piece of the anti-smoking device for stress relief and craving control purposes. In addition, the device itself and an indicium inscribed on the device may keep the user of the device in constant alert, encourage the user to continue his/her efforts, and reduce the chance that others would urge the user to smoke. Therefore, the anti-smoking device disclosed by the current invention provides both physical restrictions and psychological aid to the person wearing the device.

The anti-smoking device is small in overall size and easy to carry around. Moreover, the anti-smoking device is easy to put on and take off. Thus, it enables the user to choose to use the device when the surrounding environments present a higher chance of smoking. For example, in a gathering when some of the persons smoke, the user of the device may choose to put it on, preventing unintentional casual smoking and discouraging others from urging him/her to smoke.

The first arm and second arm of the elongated strip of the anti-smoking device may have means of attachment, such as small magnetic pieces, holes that can fit with a pin-like structure, or one half of a hook-and-loop structure attached to the arms. Correspondingly, similar means of attachment may be present on the center piece, allowing the center piece to attach to the first arm and the second arm of the elongated strip and forming two loops that may allow the fingers of the person using the device to engage. There may be multiple units of the means of attachment present on the first arm and second arm, making the sizes of the two loops individually adjustable when different unit of the means of attachment is used. Therefore, different users can adjust the loops to fit the size of their fingers. Moreover, the center piece is an ergonomic design to fit comfortable in any finger size, allowing a user to not worry about how well the anti-smoking would fit at the time of the purchase.

It is an object of the present invention to provide an anti-smoking device that is easy to use and easy to put on and take off.

It is another object of the present invention to provide an anti-smoking device that does not involves chemical intervention or pharmaceutical interference.

Yet another object of the present invention is to provide an anti-smoking device that restricts the user's physical access to a cigarette.

Still another object of the present invention is to provide an anti-smoking device that reminds the user that he/she is in an effort to quit smoking.

Still another object of the present invention is to provide an anti-smoking device that reminds the other persons that the user of the device is trying to quit smoking.

Yet another object of the present invention is to provide an anti-smoking device that is inexpensive and disposable.

Still another object of the present invention is to provide an anti-smoking device that adjustable.

Still another object of the present invention is to provide an anti-smoking device that is small in scale and easy to be carried around.

DESCRIPTION OF THE PREFERRED EMBODIMENTS

Figure 1A:
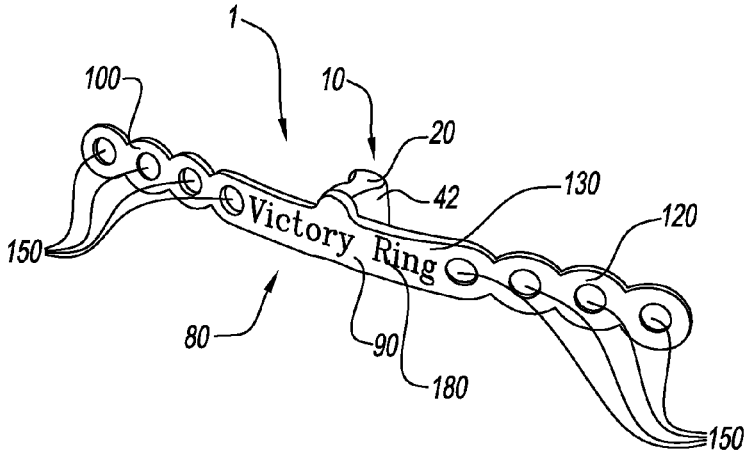
FIG. 1A is a top-front perspective view of the preferred embodiment of the present invention when the arms are not attached to the center piece.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Although this invention has been described with a certain degree of particularity, it is to be understood that the present disclosure has been made only by way of illustration and that numerous changes in the details of construction and arrangement of parts may be resorted to without departing from the spirit and the scope of the invention.

FIG. 1A shows a top front perspective view of the preferred embodiment of the anti-smoking device 1 when the first arm 100 and second arm 120 are not attached to the center piece 10. Shown are the anti-smoking device 1, the elongated strip 80 having a first arm 100, a second arm 120, and a central portion 90, and a center piece 10 having an upper side 20 and a left side 42. Also shown is an outer surface 130 of the elongated strip 80. An indicium 180 is inscribed on the outer surface 130 at the center portion 90 of the elongated strip 80. The first arm 100 and second arm 120 of the elongated strip 80 have wrapping holes 150 on them.

Figure 1B:
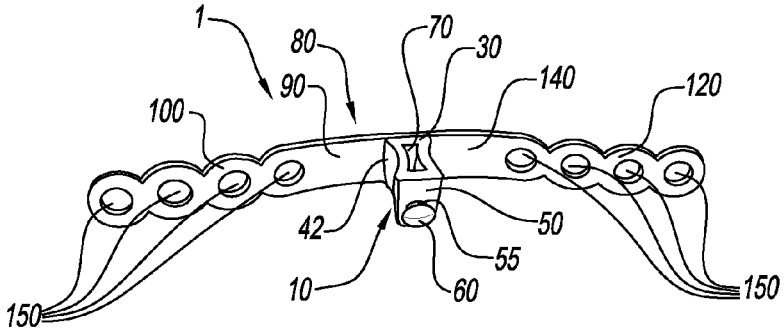
FIG. 1B is a bottom-back perspective view of the preferred embodiment of the present invention when the arms are not attached to the center piece.

FIG. 1B shows a bottom back perspective view of the preferred embodiment of the anti-smoking device 1. Shown are the anti-smoking device 1, the elongated strip 80 having a first arm 100, a second arm 120, and a central portion 90, and a center piece 10 having a lower side 30, a cavity 70 in the center piece 10 on the lower side 30, and a back side 50, as well as a pin 55 attached to the back side 50 and an enlarged head 60 attached to the pin 55. Also shown is an inner surface 140 of the elongated strip 80. The first arm 100 and second arm 120 of the elongated strip 80 have wrapping holes 150 on them.

The anti-smoking device 1 is generally small in size. The elongated strip 80 may be between 20-30 cm in length and about 1.5-2.5 cm in width. The center piece 10 is about 1.5-2.5 cm from front to back. The upper side 20 of the center piece 10 is molded to a shape that generally fits the shape of the edge of a person's palm between two fingers, which in most cases are the index finger and the middle finger, because these fingers are the ones used by most people to clutch a cigarette. The center piece 10 is an ergonomic design to fit comfortable in any finger size. The width of the center piece 10 measured at the lower side 30 is crucial to the device because it must be greater than the common diameter of a cigarette. While cigarettes vary in their sizes, the vast majority of which have diameters around or smaller than 1.0 cm. Accordingly, while width of the center piece 10 measured at the lower side 30 may vary slightly due to the cavity 70 in the center piece 10, it should be around 2 cm without squeezing the cavity 70 in the center piece 10, and it should be always around or greater than 1.5 cm, ensuring that a cigarette of a common size cannot be clutched by the two fingers engaged in the device.

The anti-smoking device 1 can be made from many kinds of materials. The elongated strip 80 is preferably flexible and easy to fold. It may be made from materials including but not limited to rubber or flexible plastics, such as Ethylene Vinyl Acetate (EVA), flexible PVC, High Density Polyethylene (HDPE), Expanded Polypropylene (EPP), or Ethylene Vinyl Acetate (EVA).

The center piece 10 of the anti-smoking device 1 may be made from either flexible or rigid materials. In the preferred embodiment shown in FIGS. 1A and 1B, the center piece 10 is preferably made from but not limited to rubber or flexible plastics, such as Ethylene Vinyl Acetate (EVA), flexible PVC, High Density Polyethylene (HDPE), Expanded Polypropylene (EPP), or Ethylene Vinyl Acetate (EVA). In addition to the materials, the cavity 70 in the center piece 10 also allows center piece 10 to be flexible. A user of the anti-smoking device 1 may squeeze the center piece 10 for stress relief and craving control, adding to the likelihood of quitting successfully.

In another embodiment of the current invention, the center piece 10 does not have cavity 70 in it. In this embodiment, the center piece 10 is preferably made from rigid but light materials, which include but not limited to plastic, foam, silicone, ABS, Polycarbonate, Noryl™, PVC, Polystryrene, ABS/PVC, PVC/Acrylic, Polysulfone, Acrylic, Polyethylene, and Kydex™. The disadvantage of this design is that the center piece 10 cannot be squeezed comfortably by a user. Nevertheless, this embodiment is even more inexpensive and the inflexibility further ensures that the wearer cannot clutch a cigarette between the fingers engaged with the anti-smoking device.

FIG. 1A also shows an optional easily read indicium 180 on the outer surface 130 of the center piece 10 of the elongated strip 80. The optional indicium 180 may contain any content, such as the name of the manufacturer of the anti-smoking device 1. The indicium 180 may also be some words or phrases that encourage the person wearing the anti-smoking device 1 to quit smoking, or it may be words or phrases to discourage others from urging the person wearing the anti-smoking device 1 to smoke. The indicium 180, together with the presence of the anti-smoking device 1 itself, serves to keep the user and others keenly aware that a conspicuous effort to quit smoking is under way.

Figure 2:
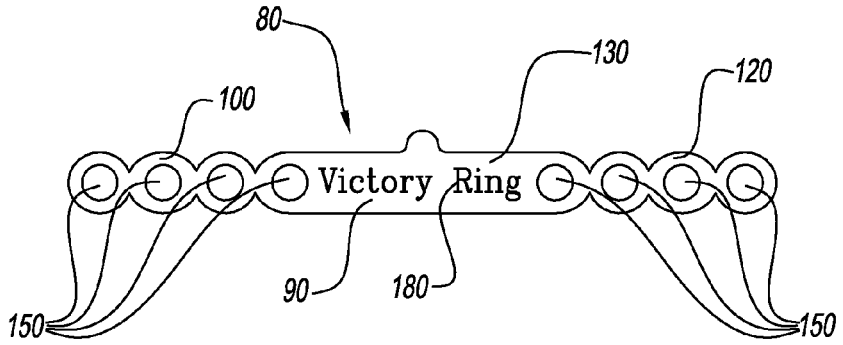
FIG. 2 is a front view of the preferred embodiment of the present invention when the arms are not attached to the center piece.

FIG. 2 shows a front view of the preferred embodiment of the present invention. Shown are the anti-smoking device 1, the elongated strip 80 having a first arm 100, a second arm 120, and a central portion 90. The first arm 100 and second arm 120 of the elongated strip 80 have wrapping holes 150 molded in the arms. Shown also is the indicium 180 inscribed on the central portion 90 of the elongated strip 80.

Figure 3:
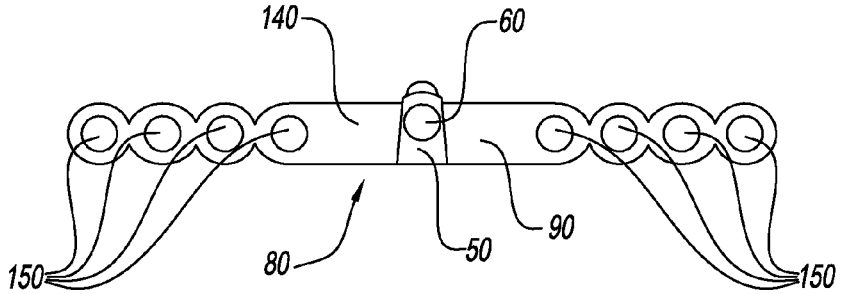
FIG. 3 is a back view of the preferred embodiment of the present invention when the arms are not attached to the center piece.

FIG. 3 shows a back view of the preferred embodiment of the present invention when the arms are not attached to the center piece. Shown are the inner surface of the elongated strip 80 having the first arm 100 and the second arm 120, with wrapping holes 150 on the first arm 100 and second arm 120. Shown are also the center piece 10, the back side 50 of the center piece 10 and the enlarged head 60 anchored to the back side 50.

Figure 4:
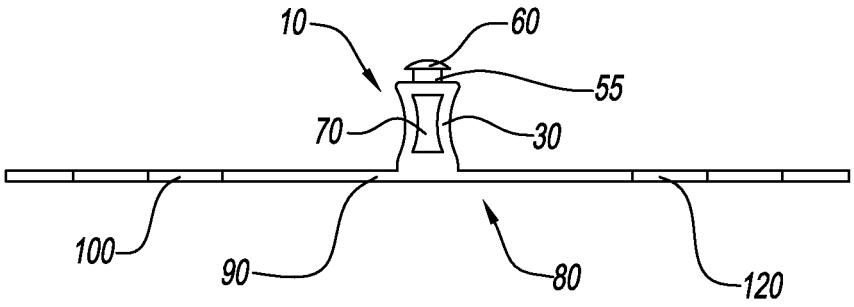
FIG. 4 is a top view of the preferred embodiment of the present invention when the arms are not attached to the center piece.

FIG. 4 shows a top view of the preferred embodiment of the present invention when the arms are not attached to the center piece. Shown are the elongated strip 80 having the first arm 100 and second arm 120, and the center piece 10 having a lower side 30 with a cavity 70 in the center piece 70 on the lower side 30. Shown also are the pin 55 attached to the back side 50 of the center piece 10 and the enlarged head 60 attached to the pin 55.

Figure 5:
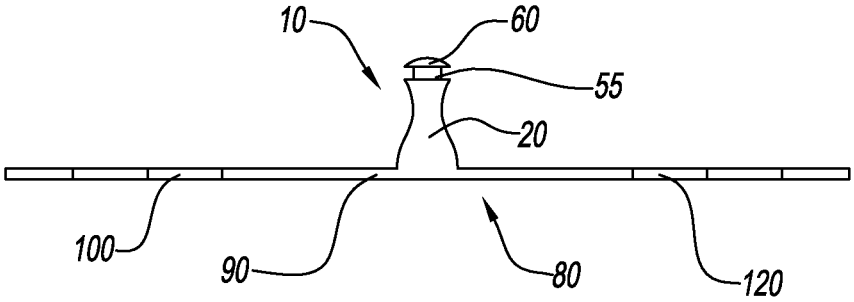
FIG. 5 is a bottom view of the preferred embodiment of the present invention when the arms are not attached to the center piece.

FIG. 5 shows a bottom view of the preferred embodiment of the present invention when the arms are not attached to the center piece. Shown are the elongated strip 80 having the first arm 100 and second arm 120, and the center piece 10 having an upper side 20 that is generally molded to the shape of a palm between two fingers. Shown also are the pin 55 attached to the back side 50 of the center piece 10 and the enlarged head 60 attached to the pin 55.

Figure 6:
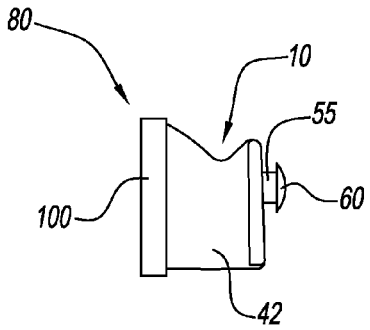
FIG. 6 is a first side view of the preferred embodiment of the present invention.

FIG. 6 shows a first side view of the preferred embodiment of the present invention. Shown are the distal end 110 of the first arm 100 of the elongated strip 80, a left side 42 of the center piece 10, and the pin 55 attached to the back side 50 of the center piece 10 and the enlarged head 60 attached to the pin 55.

Figure 7:
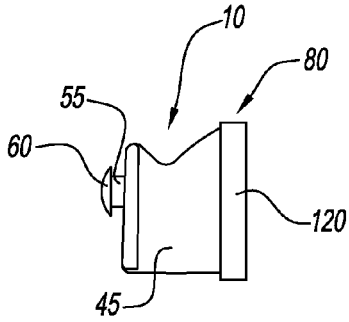
FIG. 7 is a second side view of the preferred embodiment of the present invention when the arms are not attached to the center piece.

FIG. 7 shows a second side view of the preferred embodiment of the present invention when the arms are not attached to the center piece. Shown re the distal end 125 of the second arm 120 of the elongated strip 80, a right side 45 of the center piece 10, and the pin 55 attached to the back side 50 of the center piece 10 and the enlarged head 60 attached to the pin 55.

Figure 8:
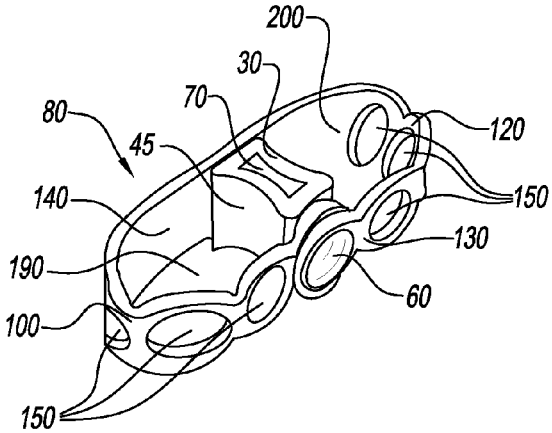
FIG. 8 is a back perspective view of the preferred embodiment of the present invention when the arms are attached to the center piece.

FIG. 8 shows a bottom back perspective view of the preferred embodiment of the present invention when the arms are attached to the center piece. Shown are the anti-smoking device 1, the elongated strip 80 having the first arm 90 and second arm 120, the wrapping holes 150 on the two arms of the elongated strip 80, the center piece 10 having a lower side 30 and a right side 45, a first side of the center piece 10, the cavity 70 in the center piece 70, and the enlarged head 60 anchored to the back side 50 of the center piece 10. In this figure, the elongated strip 80 is wrapped around the center piece 10. A wrapping hole on the first arm 90 and a wrapping hole on the second arm 120 is pushed past the enlarged head 60 and fastened to the back side 50 of the center piece 10. The first arm 90 and second arm 120, together with the center piece 10, form a first loop 200 and second loop 210 that can be engaged by two human fingers.

As indicated above, the width of the center piece 10 at the lower side 30 is carefully designed to prevent a person using the anti-smoking device 1 from being able to clutch a cigarette between the fingers wearing the device. However, people differ in their physical parameters, e.g. the size of their fingers. The first arm 90 and second arm 120 of the elongated strip 80 have multiple wrapping holes 150 in them. The diameter of the wrapping holes 150 is slightly smaller than the diameter of the enlarged head 60 but larger than the pin 55 attached to the back side 50 of the center piece 10. The wrapping holes 150 can be pushed past the enlarged head 60 because the first arm 90 and second arm 120 of the elongated strip 80 are made from flexible materials such as rubber.

The first arm 90 and second arm 120 of the elongated strip 80 can be attached to the center piece 10 through various structures, include the one shown here in the preferred embodiments. For example, the means of attachment can be a hook-and-loop structure, while the hook-and-loop can be used in such a manner that the first arm 90 can be attached to the center piece 10, and the second arm 120 can be attached to the first arm 90. In another embodiment, the means of attachments can be small magnets attached to the arms of the elongated strip 80 and the center piece 10. The measure of attachment can vary, with the key feature remains to attach the first arm 90 and second arm 120 to the center piece 10 to from the first loop 190 and second loop 200 that can be engaged by the fingers of the person using the anti-smoking device.

The various types of attachments all allow the size of the loops to be adjustable. For example, if the hook-and-loop mechanism is used, one half of the structure may span the length of the first arm 90 and second arm 120 of the elongated strip 80, while the other half of the structure may be attached to the back side 50 of the center piece 10. By changing the position of the attachment of the first arm 90 and second arm 120 to the back side 50 of the center piece 10, the sizes of the first loop 190 and second loop 200 may be adjusted.

It also should be noted that the capacity to adjust the sizes of the loops is not an indispensable feature of the current invention. In one embodiment, the first arm 90 and second arm 120 of the elongated strip 80 are permanently attached to the center piece 10, making the sizes of the first loop 190 and second loop 200 fixed. The disadvantage of this embodiment is that the device cannot fit to two different hand sizes. However, this embodiment also has the advantage of being even less expensive and more robust in structure. The person who is trying to quit smoking can choose this embodiment if the device fits his/her hand and it will not be used by another.

Figure 9A:
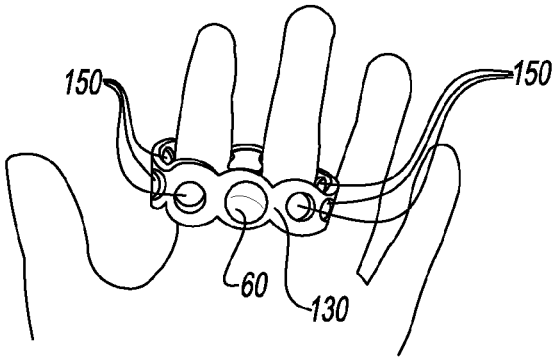
FIG. 9A is a front view of the preferred embodiment of the present invention in use.

FIG. 9A shows a back view of the preferred embodiment of the present invention in use. Shown are the first arm 90 and the second arm 120 as they are wrapped around the center piece 10. Also shown is the enlarged head 60 anchored to the center piece 10 by the pin 55, the enlarged head 60 helping to attach the first arm 90 and second arm 120 to the center piece 10. FIG. 9A shows a human hand, with the index finger and middle finger engaging the first loop 190 and second loop 200. The width of the center piece 10 is designed to be larger than the diameter of a common cigarette. By wearing the anti-smoking device 1 as shown in FIG. 9A, the person cannot clutch a cigarette, constantly reminding him/her that he is trying to quit smoking.

Figure 9B:
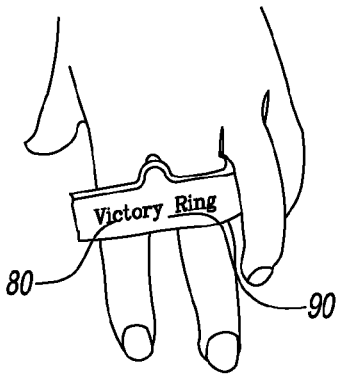
FIG. 9B is a bottom view of the preferred embodiment of the present invention in use.

FIG. 9B shows a front view of the preferred embodiment of the present invention in use. Shown are the outer surface 130 of the central portion 90 of the elongated strip 80 and the indicium 180 inscribed on the central portion 90. Again, by wearing the anti-smoking device 1, the person cannot clutch a cigarette between his index and middle fingers, the fingers most likely to be used by a smoker to hold a cigarette. The presence of the anti-smoking device 1 and the indicium 180 remind the person wearing the device, as well as his/her friends and acquaintance, that he/she is trying to quit smoking, discouraging anyone to urge him/her to smoke.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An anti-smoking device, comprising:

an elongated strip having a center portion, a first arm, and second arm along the elongated strip, wherein the strip has an outer surface and an inner surface, the outer surface and inner surface being shared by the center portion, the first arm, and the second arm;

a flexible center piece having an upper side, a lower side, a left side, a right side, a front side, a back side with each of the sides defining a cavity therebetween, wherein the front side is attached to the inner surface of the center portion of the elongated strip, and wherein the left side and the right side of the flexible center piece are concave in shape;

wherein the first arm and second arm of the elongated strip can be wrapped around the flexible center piece to attach to the flexible center piece thereby forming a first loop and a second loop that allow two adjacent human fingers to engage the first loop and the second loop respectively, and wherein the flexible center piece is positioned between the first loop and the second loop and sized such that the two adjacent human fingers cannot be held close enough to clutch a cigarette.

2. The anti-smoking device of claim 1, wherein the sizes of the first loop and the second loop are adjustable.

3. Then anti-smoking device of claim 2, wherein the lower side of the flexible center piece is molded to a shape that generally fits the edge of a human palm lying between the two adjacent human fingers engaged with the anti-smoking device.

4. The anti-smoking device of claim 3, wherein an indicium is inscribed on the outer surface of the strip.

5. The anti-smoking device of claim 1, wherein the lower side of the flexible center piece is molded to a shape that generally fits the edge of a human palm lying between the two adjacent human fingers engaged with the anti-smoking device.

6. The anti-smoking device of claim 5, wherein an indicium is marked on the outer surface of the strip.

7. The anti-smoking device of claim 1, wherein an indicium is marked on the outer surface of the strip.

8. The anti-smoking device of claim 1, wherein the flexible center piece is made from a rigid material.

9. The anti-smoking device of claim 8, wherein the first arm and second arm of the elongated strip are non-detachably attached to the flexible center piece.

10. The anti-smoking device of claim 1, wherein the first arm and second arm of the elongated strip are non-detachably attached to the flexible center piece.

11. The anti-smoking device of claim 1, wherein the flexible centerpiece has a width measured at the bottom side from the left side to the right side, and the width is equal or larger than 15 millimeters.

12. An anti-smoking device, comprising:

an elongated strip having a center portion, a first arm, and second arm along the elongated strip, wherein the elongated strip has an outer surface and an inner surface, the outer surface and the inner surface being shared by the center portion, the first arm, and the second arm, and wherein there is a first means of attachment located on the first arm and the second arm;

a flexible centerpiece having an upper side, a lower side, a left side, a right side, a front side, and a back side with each of these sides defining a cavity therebetween, wherein the front side is attached to the inner surface of the center portion of the elongated strip, wherein the left side and the right side of the flexible centerpiece are concave in shape, wherein there is a second means of attachment located on the flexible centerpiece; and wherein the first arm and second arm of the elongated strip are capable of being wrapped around the flexible centerpiece and attached to the flexible centerpiece by connecting the first means of attachment to the second means of attachment thereby forming a first loop and a second loop that allows two adjacent human fingers to engage the first loop and the second loop respectively, and wherein the flexible centerpiece is positioned between the first loop and the second loop and sized such that the two adjacent human fingers cannot be held close enough to clutch a cigarette.

13. The anti-smoking device of claim 12, wherein the flexible centerpiece has a width measured at the bottom side from the left side to the right side, and the width is equal or larger than 15 millimeters.

14. The anti-smoking device of claim 12, wherein the flexible centerpiece is designed to fit a human palm of any size.

15. The anti-smoking device of claim 12, wherein the first means of attachment are holes on the first arm and the second arm of the strip, while the second means of attachment is a pin with an enlarged head that is slightly larger than the holes on first arm and second arm of the strip.

16. The anti-smoking device of claim 14, wherein the second means of attachment is located on the back side of the flexible centerpiece.

17. The anti-smoking device of claim 14, wherein the first means of attachment is one half of a hook and loop structure, while the second means of attachment is the other half of the hook and loop structure and is located on the back side of the flexible centerpiece.

* * * * *